US005267549A

United States Patent [19]

Webber

[11] Patent Number: 5,267,549

[45] Date of Patent: Dec. 7, 1993

[54] AIR-POWERED TOY GUN

[75] Inventor: David A. Webber, Amelia, Ohio

[73] Assignee: Tonka Corporation, Pawtucket, R.I.

[21] Appl. No.: 898,305

[22] Filed: Jun. 15, 1992

[51] Int. Cl.[5] ..... F41B 11/12

[52] U.S. Cl. ..... 124/65; 124/59

[58] Field of Search ..... 124/56, 59, 63, 64, 124/65, 72, 83

[56] References Cited

U.S. PATENT DOCUMENTS

| | | | |
|---|---|---|---|
| 2,601,555 | 6/1952 | Pope . | |
| 2,630,108 | 3/1953 | White . | |
| 2,653,593 | 9/1953 | Foster . | |
| 2,749,902 | 6/1956 | Foster . | |
| 2,762,356 | 9/1956 | Foster . | |
| 3,022,779 | 2/1962 | Benkoe | 124/64 X |
| 3,726,266 | 4/1973 | Palmer | 124/59 |
| 4,848,307 | 7/1989 | Tsao | 124/59 |

*Primary Examiner*—Randolph A. Reese
*Assistant Examiner*—John Ricci
*Attorney, Agent, or Firm*—Salter, Michaelson & Benson

[57] ABSTRACT

An air powered toy gun includes first and second barrels and a manually operable piston-and-cylinder assembly which includes a cylinder, and a piston in the cylinder. The piston is movable in a first direction in the cylinder for applying pressurized air to the first barrel in order to launch a first projectile therefrom, and it is movable in an opposite second direction for applying pressurized air to the second barrel in order to launch a second projectile therefrom.

7 Claims, 3 Drawing Sheets

AIR-POWERED TOY GUN

BACKGROUND AND SUMMARY OF THE INVENTION

The instant invention relates to toy guns, and more particularly to an air-powered toy gun which is operative for firing a plurality of projectiles, such as foam balls, in rapid succession.

Air-powered toy guns which are operative for filing projectiles, such as balls and the like, have been found to have relatively high levels of appeal among children. Air-powered toy guns of this type generally comprise barrels for receiving and containing balls therein, and piston-and-cylinder assemblies which are operative for applying compressed air to the barrels thereof in order to individually launch the balls therefrom. Guns of this type, which are adapted for launching resiliently compressible balls, generally further comprise inner ridges adjacent the outer terminal ends of the barrels thereof for forming airtight seals with balls located adjacent the ridges so that sufficient amounts of air pressure can be developed before the resiliencies of the balls allows them to pass the ridges in the barrels thereof and thus break the airtight seals thereof. On the other hand, guns of this type which are adapted for launching balls which are not readily compressible normally include resilient seal members for forming airtight seals with the outermost balls in the barrels thereof so that sufficient air pressures can be developed to launch the outermost balls substantial distances. In either case, guns of this type have frequently been adapted for individually launching pluralities of balls, one ball being launched each time the piston in the piston-and-cylinder assembly of a gun is advanced forwardly a sufficient distance in the cylinder thereof to increase the air pressure in the barrel thereof to a level which is sufficient to fire the ball therefrom. However, in virtually all of the previously known guns the pistons in the piston-and-cylinder assemblies thereof must be fully retracted and then re-advanced in the cylinders thereof for second balls to be launched. Consequently, the heretofore available guns of this type have generally not been adapted for firing balls in relatively rapid succession.

The instant invention provides an effective ball shooting gun which is adapted for individually firing a plurality of balls in relatively rapid succession. Specifically, the toy gun of the instant invention comprises first and second barrels, and it is adapted for alternately firing balls from the first and second barrels thereof in relatively rapid succession. Still more specifically, the toy gun of the instant invention comprises a piston-and-cylinder assembly which is connected to the first and second barrels so that it is operative for applying pressurized air to the first barrel when the piston in the piston-and-cylinder assembly is moved in a first direction in the cylinder thereof, and so that it is operative for applying pressurized air to the second barrel when the piston in the piston-and-cylinder assembly is advanced in an opposite second direction in the cylinder thereof. Consequently, when the piston is manually advanced forwardly in the cylinder a first ball is fired from the first barrel, and when the piston is retracted in the cylinder thereof a second ball is fired from the second barrel. As a result, balls can be launched from the toy gun of the subject invention at approximately double the rate at which they can be launched from a toy gun of conventional construction.

The first and second barrels of the toy gun of the instant invention are preferably located in substantially parallel relation, and the piston-and-cylinder assembly is preferably adapted so that the piston travels in the cylinder in substantially parallel relation to the first and second barrels. The toy gun of the instant invention is preferably adapted for launching resilient foam balls from the barrels thereof, and the piston is preferably substantially axially aligned with one of the first and second barrels. Each of the first and second barrels is preferably adapted for receiving a plurality of balls therein so that a plurality of balls can be individually launched from each of the barrels.

It has been found that the toy gun of the instant invention has specific advantages over the previously available toy guns. Specifically, it has been found that the toy gun of the instant invention is capable of launching a plurality of foam balls from each of two separate barrels, and that as a result, it is capable of launching balls at approximately double the rate of conventional ball shooting guns. Further, because the barrels are in substantially parallel relation the balls from the two barrels are launched in approximately the same direction. Still further, because the piston-and-cylinder assembly is preferably axially aligned in substantially parallel relation with one of the barrels, a user can more easily aim the gun while reciprocally moving the piston in the same general direction as the barrels are aimed.

Accordingly, it is a primary object of the instant invention to provide a toy gun which is operative for launching a plurality of balls in rapid succession.

Another object of the instant invention is to provide a toy gun which is capable of alternately launching balls from each of two separate barrels.

An even still further object of the instant invention is to provide a toy gun which is operative for shooting a ball from a first barrel when a piston of a piston-and-cylinder assembly is moved in a first direction, and for shooting a second ball from a second barrel when the piston is moved in an opposite second direction.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
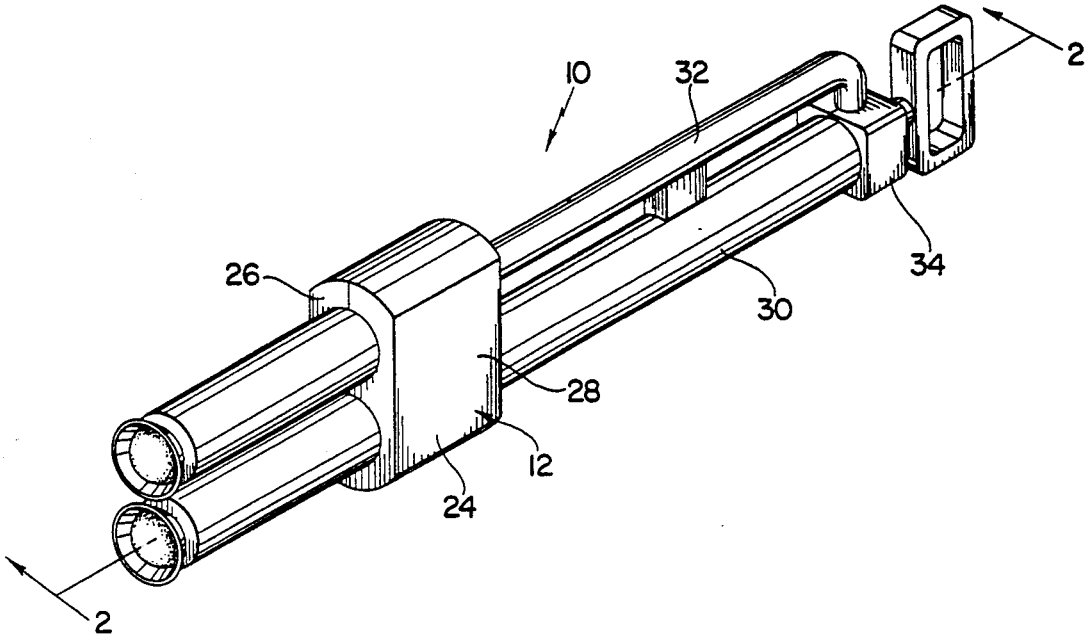
FIG. 1 is a perspective view of the toy gun of the instant invention.
Figure 2:
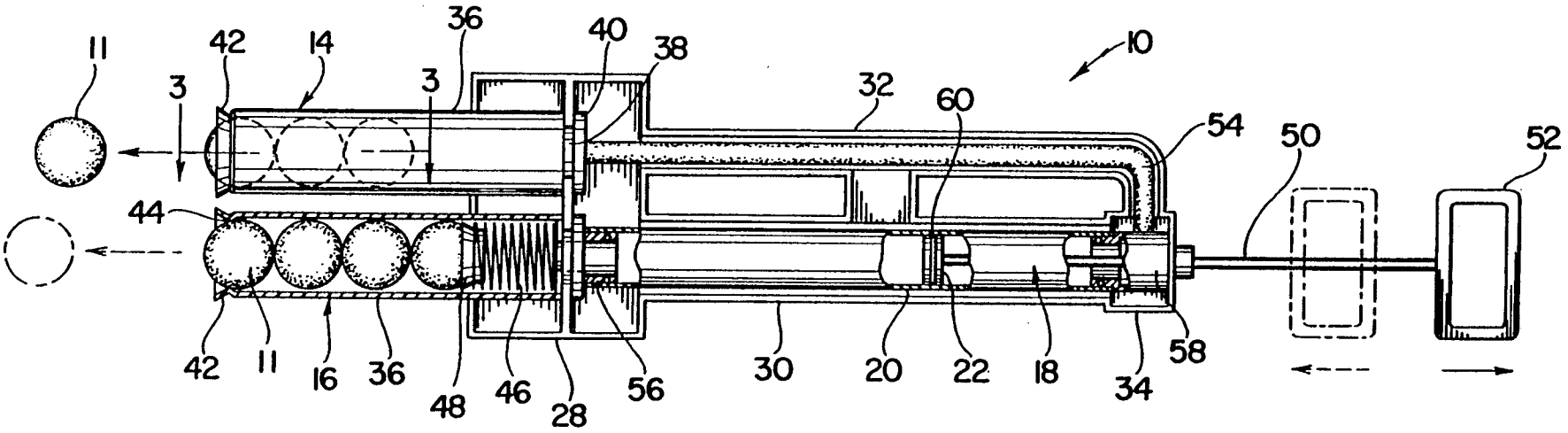
FIG. 2 is a side elevational view thereof shown in partial section with one side of the main housing removed.

Referring now to the drawings, the toy gun of the instant invention is illustrated and generally indicated at 10 in FIGS. 1 and 2. The gun 10 is operative for shooting foam balls 11, and it comprises an outer housing assembly generally indicated at 12, first and second barrel assemblies generally indicated at 14 and 16, respectively, which are mounted in the housing assembly 12, and a piston-and-cylinder assembly generally indicated at 18. The piston-and-cylinder assembly 18 includes a cylinder 20 and a piston 22 which is reciprocally movable in the cylinder 20. The cylinder 20 is connected to the first and second barrel assemblies 14 and 16, respectively, so that pressurized air from the piston-and-cylinder assembly 18 is supplied to the first barrel assembly 14 when the piston 22 is moved in one direction in the cylinder 20, and so that pressurized air is delivered to the second barrel assembly 16 when the piston 22 is moved in an opposite direction in the cylinder 20. Accordingly, when a plurality of the balls 11 is received in each of the first and second barrel assemblies 14 and 16, respectively, and the piston 22 is reciprocally moved in the cylinder 20, individual balls 11 are alternately fired from the first barrel assembly 14 and the second barrel assembly 16.

The housing assembly 12 comprises left and right housing sections 24 and 26, respectively, which cooperate to form a housing for mounting the barrel assemblies 14 and 16 and for containing the piston-and-cylinder assembly 18. The housing 12 as formed by the housing sections 24 and 26, includes a front barrel-mounting portion 28, a piston-and-cylinder housing portion 30, an air conduit portion 32, and a rear end portion 34.

Figure 3:
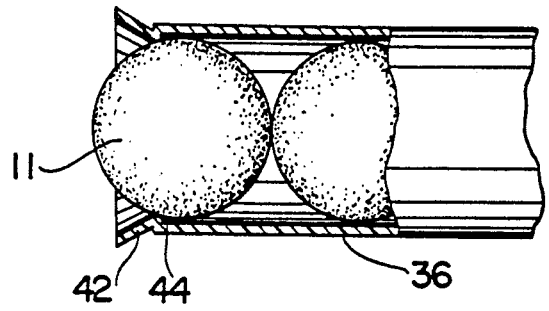
FIGS. 3 through 5 are sequential sectional views illustrating the launching of a foam ball from the gun.
Figure 4:
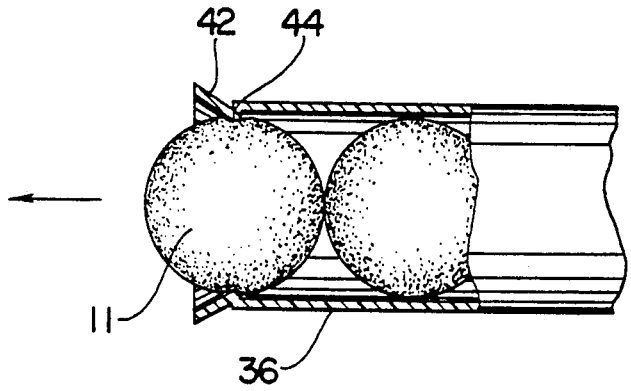
Figure 5:
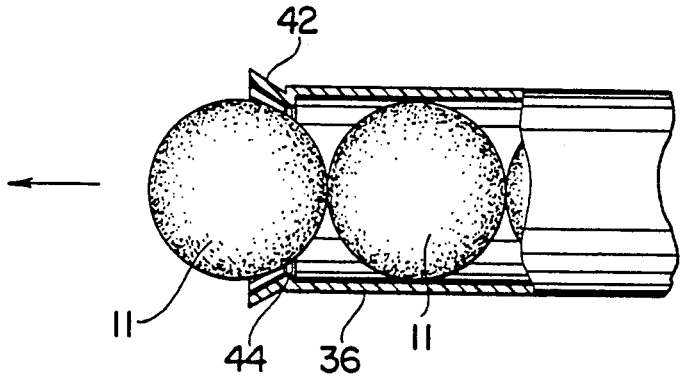

Each of the barrel assemblies 14 and 16 comprises a tubular member 36 having a reduced rear neck portion 38 and an enlarged end plate 40 which are adapted to be received in the barrel mounting section 28 of the housing 12 for mounting the barrel assemblies 14 and 16 therein, as illustrated in FIG. 2. Each of the tubular members 36 further includes a flaired front end portion 42, and an inwardly extending ridge 44 which is located adjacent the flaired portion 42 thereof. The ridges 44 define slightly reduced front end openings in the tubular members 36 which are of slightly smaller diameter than the balls 11. Consequently, the ridges 44 are operative in combination with the balls 11 as airtight seals for releasably retaining the balls 11 in the barrel assemblies 14 and 16, and for enabling the tubular members 36 to be pressurized with air from the piston-and-cylinder assembly 18 so that the balls 11 can be individually fired from the barrel assemblies 14 and 16. In this regard, as illustrated in FIGS. 3 through 5, each of the balls 11 must be resiliently deformed slightly to pass beyond the ridge 44 in the cylinder 36 thereof as pressurized air in the respective tubular member 36 thereof operates to force the ball 11 outwardly and forwardly. In the gun as hereinembodied, each of the tubular members 36 is adapted for receiving and containing four balls 11, although it will be understood that other embodiments which are adapted for containing different quantities of balls 11 are contemplated. Further, other embodiments of the gun 10 are contemplated which include barrel assemblies 14 and 16, which are adapted for firing other types of projectiles. In any event, the barrel assemblies 14 and 16 as hereinembodied each further comprise a coil spring 46 in the tubular member 36 thereof, and a front cup portion 48 on the forward end of the coil spring 46 thereof. The coil springs 46 are operative for urging the balls 11 forwardly in the tubular members 36 so that whenever one or more balls 11 is received in one of the tubular members 36, the forwardmost ball 11 therein is maintained in engagement with the ridge 44 of the tubular member 36 to provide a seal which enables air pressure to be built up in the tubular member 36.

The piston-and-cylinder assembly 18 comprises the cylinder 20, the piston 22, a piston rod 50 having a handle 52, and a tubular air conduit 54. The forward end of the cylinder 20 is received in sealing engagement on a rear extension 56 of the second barrel assembly 16, and the tubular conduit 54 extends between a rear end cap 58 on the cylinder 20 and the rear end of the first barrel assembly 14. The piston 22 includes a center seal 60 and it is slidably received in sealed engagement in the cylinder member 20. The piston rod 50 is attached to the piston 22 and it extends rearwardly through the end cap 58 and the rear housing section 34, so that a user can advance and retract the piston 22 in the cylinder member 20 utilizing the handle 52. As illustrated, when the handle 52 is advanced forwardly to advance the piston 22 forwardly in the cylinder 20, compressed air is forced into the second barrel assembly 16 so that one of the balls 11 is fired therefrom, whereas when the piston 22 is moved rearwardly in the cylinder 20 compressed air is forced through the conduit 54 and into the first barrel assembly 14 so that one of the balls 11 is fired from the first barrel assembly 14.

It is seen therefore that the instant invention provides an effective toy gun which is operative for firing the balls 11 in rapid succession. In this regard, when the handle 52 is moved forwardly to move the piston 22 forwardly in the cylinder 20, one of the balls 11 is fired from the second barrel assembly 16. On the other hand, when the handle 52 is pulled rearwardly to move the piston 22 rearwardly in the cylinder 20, a ball 11 is fired from the first barrel assembly 14. Accordingly, the balls 11 can be fired from the gun 10 at approximately twice the rate at which they can be fired from a similar gun having only a single barrel assembly. For these reasons, it is seen that the toy gun of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An air-powered toy gun comprising:

a. a plurality of projectiles;

b. first barrel means for launching a first one of said projectiles therefrom in response to the application of pressurized air to said first barrel means;

c. second barrel means for launching a second one of said projectiles therefrom in response to the application of pressurized air to said second barrel means; and d. manually operable piston-and-cylinder means connected to said first and second barrel means and including a cylinder and a piston reciprocally movable in opposite first and second directions in said cylinder for applying pressurized air to said first barrel means during movement of said piston in said first direction and for applying pressurized air to said second barrel means during movement of said piston in said second direction in order to launch said first and second projectiles, respectively, therefrom.

2. In the toy gun of claim 1, said first and second barrel means being substantially parallel, said piston travelling in said cylinder in substantially parallel relation to said first and second barrel means.

3. In the toy gun of claim 1, said projectiles comprising balls, said barrel means being adapted for launching said balls therefrom.

4. In the toy gun of claim 3, said projectiles comprising resilient foam balls.

5. In the toy gun of claim 3, each of said first and second barrel means being adapted for individually launching a plurality of said balls therefrom one ball being launched from each of said barrel means each time said piston-and-cylinder means is operated for applying a sufficient quantity of pressurized air thereto to launch a ball therefrom.

6. In the toy gun of claim 3, each of said first and second barrel means including a tubular magazine for containing and individually dispensing a plurality of said balls therefrom, 7. In the toy gun of claim 1, said piston-and-cylinder means being substantially axially aligned with one of said first and second barrel means.

* * * * *